US006154117A

United States Patent [19]

Sato et al.

[11] Patent Number: 6,154,117

[45] Date of Patent: Nov. 28, 2000

[54] THERMAL SWITCH

[75] Inventors: Shigemi Sato, Aichi; Hideki Koseki, Niwa-gun, both of Japan

[73] Assignee: Ubukata Industries Co., Ltd., Nagoya, Japan

[21] Appl. No.: 09/287,330

[22] Filed: Apr. 7, 1999

[51] Int. Cl.[7] ..... H01H 37/74; H01H 61/00; H01H 37/04

[52] U.S. Cl. ..... 337/365; 337/354; 337/380; 337/89

[58] Field of Search ..... 337/333, 354, 337/365, 89, 53, 372, 380, 368, 377, 367, 91, 94, 102, 112, 113, 77, 111, 104, 105; 29/622

[56] References Cited

U.S. PATENT DOCUMENTS

| | | | |
|---|---|---|---|
| 3,657,618 | 4/1972 | Ori et al. | 318/102 |
| 4,114,127 | 9/1978 | Pejouhy | 337/97 |
| 4,266,211 | 5/1981 | Ulanet | 335/208 |
| 4,287,499 | 9/1981 | Pejouhy | 337/97 |
| 4,389,630 | 6/1983 | Ubukata et al. | 337/363 |
| 4,472,705 | 9/1984 | Carlson | 337/299 |
| 5,107,241 | 4/1992 | Ubukata et al. | 337/368 |
| 5,121,095 | 6/1992 | Ubakata et al. | 337/365 |
| 5,229,740 | 7/1993 | Mizutani et al. | 337/354 |
| 5,939,970 | 8/1999 | Tsuji et al. | 337/343 |

*Primary Examiner*—Leo P. Picard
*Assistant Examiner*—Anatoly Vortman
*Attorney, Agent, or Firm*—Foley & Lardner

[57] ABSTRACT

A thermal switch includes a metal header plate having two through holes, two terminals inserted through and airtightly fixed in the through holes of the header plate, a metal housing including a cylindrical portion having an open end and a generally shallow dish-shaped bottom, the open end being welded to the header plate so that the metal housing and the head plate constitute a hermetic housing, and a thermally responsive element formed into the shape of a shallow dish and disposed on the bottom of the metal housing the thermally responsive element reversing its curvature at a first temperature with snap action and re-reversing its curvature at a second temperature with snap action to return to its former state. The metal housing has a N thickness set to a range of 1/60 to 1/20 of a diameter of the cylindrical portion and a length of the cylindrical portion is set to a value equal to one half as large as its diameter or above, so that heat conduction through the bottom of the metal housing to the thermally responsive element and heat conduction from the housing bottom side through the cylindrical portion of the housing toward the header plate are regulated so that a temperature rise rate of the thermally responsive element is adjusted.

19 Claims, 8 Drawing Sheets

| | Example 1 | Example 2 | Example 3 | Example 4 | Example 5 | Prior art |
|---|---|---|---|---|---|---|
| | SUS304 | SUS304 | SUS304 | Steel plate (SPCE) | Steel plate (SPCE) | Steel plate (SPCE) |
| $\lambda$ | 0.015 | 0.015 | 0.015 | 0.062 | 0.062 | 0.062 |
| L | 6.8 | 12.1 | 12.1 | 6.8 | 12.1 | 5.5 |
| t | 0.3 | 0.3 | 0.4 | 0.3 | 0.3 | 0.3 |
| Estimated operating time T1 | 26.56 | 14.99 | 23.05 | 90.18 | 51.84 | 110.9 |
| Operating time (average measured value) | 25.9 | 15.2 | 23.4 | 89.4 | 51.8 | 115.7 |

FIG. 7

THERMAL SWITCH

BACKGROUND OP THE INVENTION

1. Field of the Invention

This invention relates generally to a thermal switch including a bimetal or trimetal thermally responsive element, and more particularly to such a thermal switch provided in, for example, an automobile to detect a temperature of equipment such as a compressor circulating refrigerant to a heat exchange system or an engine transmission for the purpose of protecting the equipment against an overheat or an overcurrent in an abnormal condition.

2. Description of the prior art

There have conventionally been provided thermal switches of the above-described type which open and close an electric circuit using deformation of a bimetal or trimetal. FIG. 8 illustrates one of the conventional thermal switches. The thermal switch 101 comprises a generally circular metal header plate 102 and a cylindrical bottomed housing 103. An open end of the housing 103 is airtightly welded or otherwise secured to the header plate 102, so that a hermetic housing is constituted by the header plate 102 and the cylindrical housing 103. The hermetic housing is used to prevent penetration of water etc. thereinto and to maintain a stable state of composition of a gas filling an interior thereof for a long period. The cylindrical housing 103 is made of a steel plate which provides a good veldability.

The header plate 102 has two through holes 102A and 102B. Two electrically conductive metal terminal pins 104A and 104B are inserted through the respective holes 102A and 102B and hermetically secured in the respective holes by an electrically insulating filler 105 such as glass. A generally C-shaped thick electrically conductive fixed contact member 106 is welded or otherwise secured at its upper end to a lower end of one terminal pin 104A. An elastic movable contact member 107 has a fixed end 107A welded or otherwise secured to a lower end of the other terminal pin 104B. The movable contact member 107 further has a distal end 107B to which a movable contact 108 is secured so as to come into contact with a contact portion 106A of the fixed contact member 106.

A thermally responsive element 109 is made by punching a disc out of a material such a bimetal and forming the disc into the shape of a shallow dish. The thermally responsive element 109 is placed on the bottom of the housing 103, and a retainer 110 made of an elastic material is placed on the thermally responsive element 109. A pressure piece 111 is further provided on the retainer 110. The pressure piece 111 is made of an electrically and thermally resisting material and has a distal end force-fitted into a hole 107C formed in the movable contact member 107 to be fixed.

The thermally responsive element 109 of the thermal switch 101 is downwardly convex at a normal temperature. When the ambient temperature is increased to reach a predetermined value, the thermally responsive element 109 reverses its curvature with snap action so as to be upwardly convex. An upwardly convex central portion pushes the pressure piece 111 upward. The pressure piece 111 then pushes the movable contact member 107 upward so that the distal movable contact 108 is disengaged from the contact portion 106A of the fixed contact member 106, whereupon an electric circuit between the terminal pins 104 and 104B is broken.

FIGS. 9 and 10 show the above-described thermal switch 101 mounted on a compressor for a car air conditioner for the purpose of protecting the compressor against the overheat or the overcurrent. The compressor comprises a casing A previously provided with a mounting section A1 which is a through hole open to a passage of discharged refrigerant. The mounting section A1 is positioned so that the thermal switch 101, when mounted thereon, can quickly detect a temperature of the refrigerant.

Lead wires 112A and 112B are connected to the terminal pins 104A and 104B of the thermal switch 101 respectively. A protective cap 113 is put onto the thermal switch 101 in order that water etc. may be prevented from penetrating connections between the terminal pins and the lead wires during the service and so that the thermal switch 101 may be protected against an external force or vibration applied thereto during the mounting of the thermal switch. For these purposes, too, the mounting section is filled with an insulating filler 114. The thermal switch 101 is inserted into the mounting section A1 together with an O-ring 115 made of silicon rubber or the like. A known arcuate elastic member 116 such as a snap ring is attached to an upper peripheral end of the protective cap 113 to hold the latter, whereby the mounting section A1 is closed by the thermal switch.

In the above-described thermal switch, the thermally responsive element 109 is positioned on the bottom of the housing 103 so that a high thermal responsiveness can be achieved. On the other hand, smaller thermal switches have recently been desired in view of a problem of the position where the thermal switch is mounted. However, when the thermal switch is mounted on the casing of the car air conditioner compressor which is usually exposed to outside air, beat of the surface of the compressor casing is absorbed into the outside air. Accordingly, heat of the thermal switch mounted directly on the compressor casing is absorbed into the outside air and by heat conduction through the compressor casing. Particularly when the outside air temperature is low, the above-described thermal switch cannot provide a sufficient thermal responsiveness for a rapid increase in the refrigerant temperature. Further, the header plate 102 necessitates a sufficient thickness for holding the terminal pins 104A and 104B. This results in are increase in the heat capacity of the header plate 102. As a result, heat at the distal end of the housing is absorbed via its cylindrical portion into the header plate 102. This reduces a temperature increasing speed of the thermally responsive element 109 and accordingly, the responsiveness of the thermal switch. Particularly when the housing is rendered smaller, the length of the cylindrical portion of the housing is also reduced, so that heat tends to be absorbed into the header plate side.

A mounting manner as shown in FIG. 11 is effective for increase in the response speed of the thermal switch. In this manner, the thermal switch 101 is fixed to a distal end of a terminal pin 122A of a closed terminal 122 electrically connecting between the exterior and the interior of the compressor 121. Thus, heat conduction from the thermal switch to the outside of the compressor can be minimized by locating the thermal switch inside an inner wall of the compressor casing only by means of the terminal pin, and the thermal responsiveness can be improved by exposing the overall thermal switch to the refrigerant as a heating medium or a heat carrier. An alternative characteristic experiment made by the inventors with use of oil instead of the heating medium shows that a response time is shortened to one half or less. The inventors have confirmed that the same result can be achieved in the actual use. In the above-described mounting manner, however, the refrigerant passage is required to have such a width that the thermal switch is accommodated therein. This requirement renders the compressor housing large-sized and increases the number of components of the compressor, resulting in an increase in the manufacturing cost of the system. Further, the above-described problem of reduction in the temperature increasing speed of the thermally responsive element due to the large heat capacity of the header plate still remains unsolved in this mounting manner.

SUMMARY OF THE INVENTION

Therefore, an object of the present invention is to provide a thermal switch which can improve the thermal responsiveness without increasing the size of the casing and the number of components of the compressor.

The present invention provides a thermal switch comprising a generally circular metal header plate having two through holes, first and second terminals inserted through and airtightly fixed in the through holes of the header plate by an electrically insulating filler respectively, a metal housing including a cylindrical portion having an open end and a generally shallow dish-shaped bottom, the open end being welded to the header plate so that the metal housing and the head plate constitute a hermetic housing, a generally circular thermally responsive element formed into the shape of a shallow dish and disposed on the bottom of the metal housing, the thermally responsive element reversing a curvature thereof at a predetermined first temperature with snap action and re-reversing the curvature thereof at a predetermined second temperature with snap action to return to a former state thereof, a retainer having elasticity and disposed opposite the thermally responsive element, a fixed contact member welded to the first terminal, a movable contact member welded to the second terminal, and a pressure piece provided on the movable contact member so as to conf ront the thermally responsive element. In this thermal switch, the fixed and movable contact members have weld portions welded to the first and second terminals respectively in such a manner that when a welding jig is disposed on each of imaginary lines extending in one and the same direction and passing through centers of the terminals and weld points respectively, disposition of the welding jig for either one terminal is allowed by the other terminal. Further, the metal housing has a thickness set to a range of 1/60 to 1/20 of a diameter of the cylindrical portion thereof and a length of the cylindrical portion is set to a value equal to one half as large as the diameter thereof or above, so that heat conduction through the bottom of the metal housing to the thermally responsive element and heat conduction from the housing bottom side through the cylindrical portion of the housing toward the header plate are regulated so that a temperature rise rate of the thermally responsive element is adjusted.

According to the above-described construction, heat at the bottom of the metal housing of the thermal switch is restrained from transferring from the cylindrical portion of the housing to a casing of a compressor when the thermal switch is used to protect the compressor. Accordingly, since an escape of heat is restrained in a case of rapid rise of the temperature of refrigerant, the thermally responsive element is effectively heated. Consequently, a response speed of the thermal switch can be improved.

In another form, the metal housing is made of a metal having a heat conductivity equal to one half of a heat conductivity of iron or below so that when the metal housing portion is subjected to heat, a conductivity of the heat transferred to the header plate side is restrained and a heat conductivity of the housing bottom is increased. More specifically, the metal housing is preferably made of an alloy of iron and chrome, an alloy of iron and nickel, an alloy of iron, nickel and chrome or an alloy of nickel and chrome. The heat at the bottom of the metal housing is restrained from transferring from the cylindrical portion of the housing to the compressor casing even when the metal housing has the same shape as that of the convention thermal switch. Further, the thickness and the length of the cylindrical portion of the metal housing are set so as to be correlated with each other. Consequently, since the heat at the housing bottom is quickly transferred to the thermally responsive element, a response speed of the thermal switch can be improved. Further, by determining the thickness and the length of the metal housing and its heat conductivity as described above, the thermal responsiveness of the thermal switch can be improved to a large extent only when the size of the thermal switch is the same as or slightly larger than that of the conventional one. Consequently, the thermal switch can be mounted at a conventional mounting position and the size of the compressor casing need nor be increased.

In further another form, the closed housing is filled with a filler gas containing 50 to 90%-helium with a charge pressure equal to or above an atmospheric pressure. Consequently, the heat of the housing can quickly be transferred to the thermally responsive element particularly in a case of rapid rise of the ambient temperature. Further, since the charge pressure for the filler gas is equal to or above the atmospheric pressure, an external gas is prevented from entering the metal housing. Consequently, the composition of the filler gas can be maintained in a stable state for a long period.

In further another form, the header plate has a circumferential edge in the vicinity of which a stepped portion is provided and the housing includes, in the vicinity of the open end thereof, an inner circumferential face adjacent to an outer edge of the stepped portion of the header plate. As the result of this construction, when the header plate and the metal housing are welded together, the stepped portion can prevent dust produced during the welding from entering the housing. Further, the header plate and the housing can be positioned reliably and readily in the assembly.

In further another form, lead wires are welded to the first and second terminals respectively. Consequently, the thermal switch can serve under the condition at a higher temperature than the conventional thermal switch in which lead wires are soldered to respective terminals.

Other objects, features and advantages of the present invention will become clear upon reviewing the following description of the preferred embodiment, made with reference to the accompanying drawings, in which;

FIG. 7 shows results of an alternative characteristic experiment;

DETAILED DESCRIPTION OF THE PREFERRED EMBODIMENT

Figure 1:
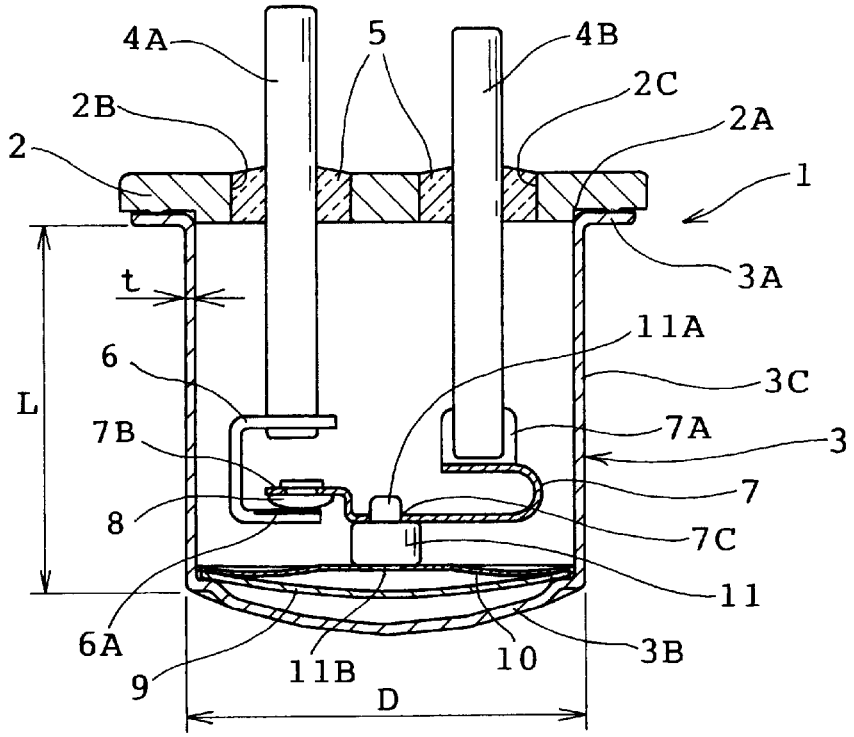
FIG. 1 is a longitudinal section of a thermal switch of one embodiment in accordance with the present invention, showing a state where a movable contact is in engagement with a fixed contact.
Figure 2:
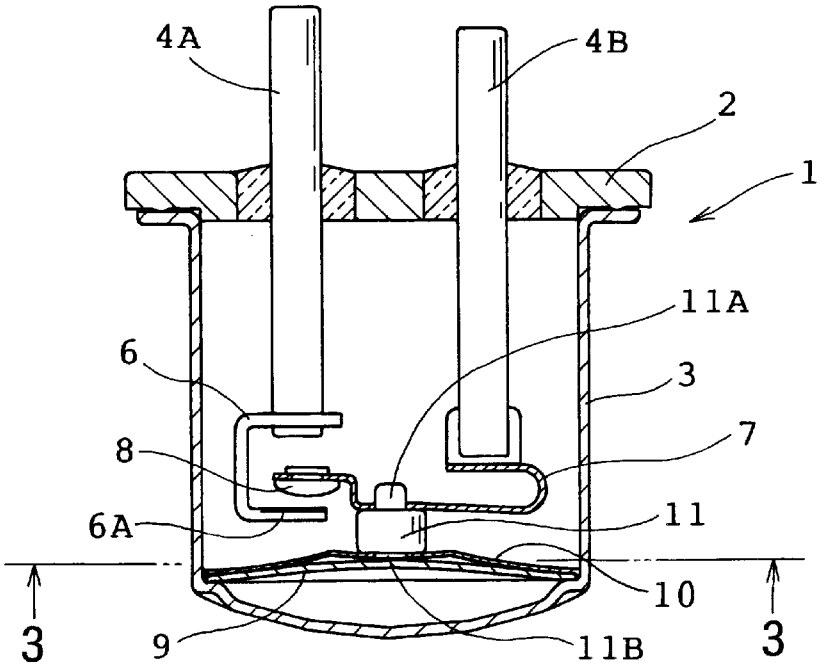
FIG. 2 is also a longitudinal section of the thermal switch, showing another state where the movable contact is disengaged from the fixed contact.

One embodiment of the invention will be described with reference to FIGS. 1 to 7. Referring to FIG. 1, a thermal switch 1 of the embodiment is shown. The thermal switch 1 includes a generally circular metal header plate 2 and a cylindrical bottomed metal housing 3. The metal housing 3 has a flange 3A formed integrally on an open end thereof airtightly secured to a circumferential edge of the header plate 2 by means of ring projection welding, so that the header plate 2 and the metal housing 3 constitute a hermetic housing. The housing 3 is made, for example, by pressing a metal plate so that it is formed into a bottomed cylindrical shape byr means of drawing. The housing 3 includes a bottom 3B and a cylindrical portion 3C having a length L set to be longer than that of the conventional thermal switch, so that heat transfer floor the bottom 3B side to the header plate 2 side through the cylindrical portion 3C is restrained. Further, in order that the bottom 3B of the housing 3 may have a high withstand pressure, it is formed into the shape of a spherical shallow dish as shown in FIG. 1.

Paying attention to heat transfer through the metal housing, the inventors have obtained a relationship among a heat conductivity of the housing relative to a response time of the thermal switch, a length and a thickness of the cylindrical portion of the housing. More specifically, as the heat conductivity of the housing becomes low, heat applied to the bottom of the housing is less transferable outside. Further, as the thickness of the cylindrical portion of the housing becomes small, its sectional area is reduced and accordingly, the heat is less transferable. In the embodiment, the thickness t of the housing remains unchanged and the length L of the cylindrical portion is rendered larger than that iil the prior art, so that the heat transfer from the bottom side to the header plate side through the cylindrical portion is restrained.

The header plate 2 has first and second through holes 2B and 2C. Two metal terminal pins 4A and 4E serving as first and second terminals of the thermal switch are inserted through and airtightly fixed in the through holes 2B and 2C by an electrically insulating filler 5, respectively. A generally C-shaped thick electrically conductive fixed contact member 6 includes an upper end welded to a portion of the terminal pin 4A near the lower end thereof. The fixed contact member 6 is provided with a fixed contact 6A at a distal end thereof. The fixed contact 6A is made of a silver alloy. A movable contact member 7 has a fixed end 7A welded to a portion of the terminal pin 4B near the lower end thereof. The movable contact member 7 is made of a copper alloy having a sufficient elasticity, such as beryllium copper. A movable contact 8 made of a silver alloy is carried on a distal end 7B of the movable contact member 7 so as to be brought into contact with the fixed contact 6A of the fixed contact member 6.

Figure 3:
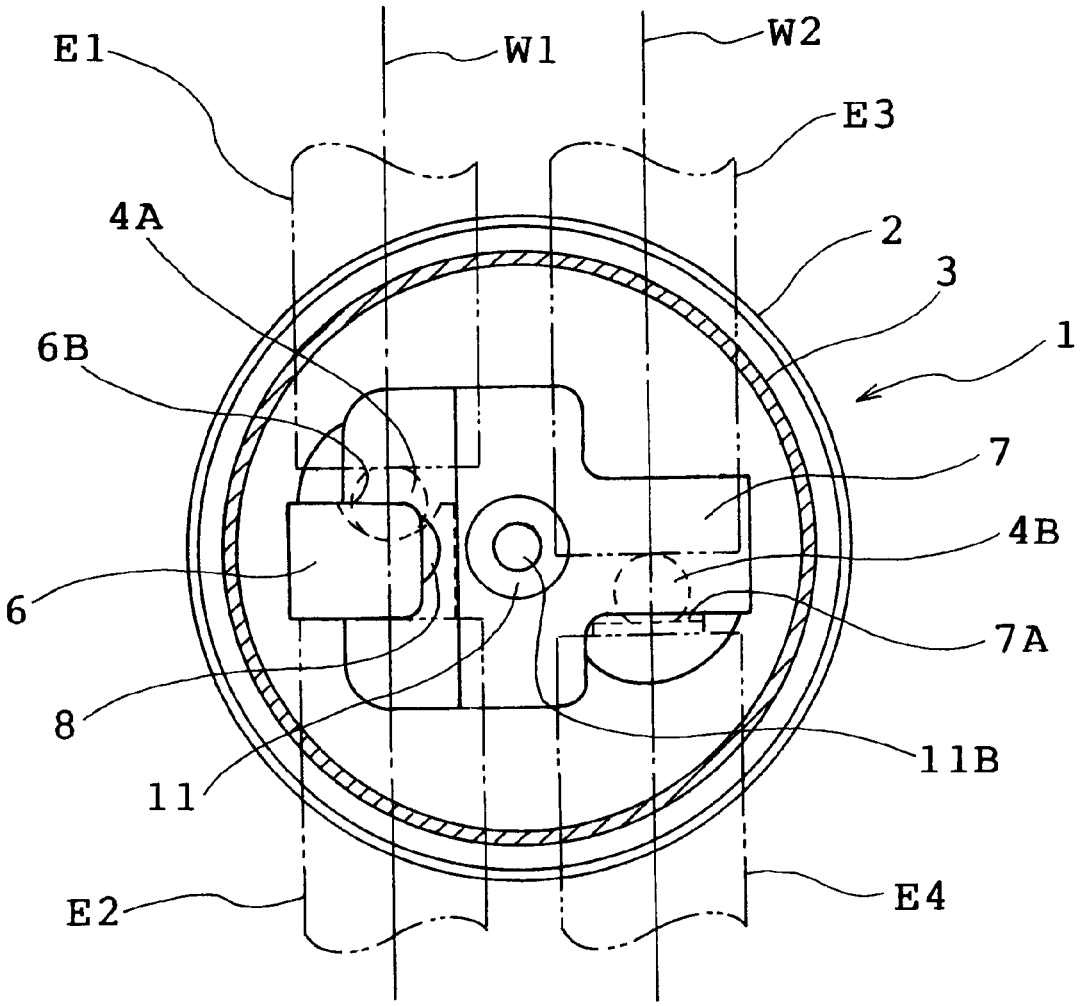
FIG. 3 is a sectional view taken along line 3—3 in FIG. 2.

The fixed and movable contact members 6 and 7 have weld portions 6B and 7A welded to the first and second terminals 4A and 4B in one and the same direction respectively as shown in FIG. 3. Further, weld positions are determined so that welding jigs or a pair of welding electrodes E1 and E2 and another pair of welding electrodes E3 and E4 disposed on imaginary lines passing through centers of the terminals and weld points respectively are not obstructed by each counterpart terminal pin. That is, the terminal pins 4A and 4B are positioned so as not to interfere with the welding of the respective counterpart contact members. As a result, an assembling work can be rendered easy and welding can readily be automated. Further, since the shapes of the welding jigs such as the welding electrodes are rendered reasonable with respect to a pressing direction, the service life of each welding jig can be improved and a maintenance work can be reduced. Additionally a small-sized thermal switch with a reduced distance between the terminal pins can be manufactured.

A thermally responsive element 9 is placed on the bottom 3B of the metal housing 3. The thermally responsive element 9 is made by punching a disc out of a material such as a bimetal and shaping the disc into the shape of a shallow dish so that its curvature is reversed and returned at different temperatures. A retainer 10 made of an elastic material is placed on the thermally responsive element 9. A pressure piece 11 is further provided on the retainer 10. The pressure piece 11 is made of an electrically and thermally resisting material such as a ceramic. The pressure piece 11 has a distal end 1A force-fitted into a through hole 7C formed in a central portion of the movable contact member 7.

The retainer 10 is made of a thin elastic plate such as phosphor bronze or beryllium copper. The retainer 10 has a plurality of, for example, four, slender legs 10A extending radially from its center and bent at a predetermined angle so that the retainer is formed generally into the shape of an umbrella. The retainer 10 is positioned so as to normally push the thermally responsive element 9 toward the bottom 3B by such a small force as not to adversely affect the operation of the thermally responsive element. The retainer 10 has a centrally formed through hole 10B through which a lower end 11B of the pressure piece 11 is inserted, slightly protruding therefrom. This arrangement renders the positioning of the pressure piece 11 easy and prevents deformation of the retainer 10 due to repeated reversing and returning operations of the thermally responsive element 9, which deformation will be described later. Further, the retainer 10 is a thin plate and its legs 10A are slender. Additionally, only distal ends of the legs 10A are brought into contact with the thermally responsive element 9. Accordingly, heat of the thermally responsive element 9 is difficult to transfer through the retainer 10 to the pressure piece 11. Thus the retainer 10 serves to restrain heat from escaping through the terminal pins 4A and 4B.

The thermally responsive element 9 operates basically in the same manner as that of the conventional thermal switch described hereinbefore. More specifically, the thermally responsive element 9 is downwardly convex at a normal temperature as shown in FIG. 1. When a predetermined first temperature is reached with an increase in the ambient temperature, the thermally responsive element 9 reverses its curvature with snap action so as to be upwardly convex. Accordingly, the central portion of the thermally responsive element 9 abuts the lower end 11B of the pressure piece 11 inserted through the central hole 10B of the retainer 10, pushing the pressure piece 11 upward. The pressure piece 11 pushes the movable contact member 7 upward such that the movable contact 8 carried on the distal end of the an movable contact member is disengaged from the fixed contact 6A of the fixed contact member 6, whereupon the electric circuit between the terminal pins 4A and 4B is broken.

Thereafter, when the temperature of the thermally responsive element 9 drops to reach a predetermined second temperature, the thermally responsive element 9 returns to its former curvature such that the movable contact 8 re-engages the fixed contact 6A, whereupon the electric circuit between the terminal pins 4A and 4B is made. In the construction that the lower end 11B of the pressure piece 11 is inserted through the hole 10B of the retainer 10 so as to slightly protrude therefrom, the thermally responsive element 9 directly collides with the lower end of the pressure piece when reversing its curvature to be upwardly convex in the above-described protecting operation. Accordingly, the retainer 10 is prevented from being repeatedly stricken between the thermally responsive element 9 and the pressure piece 11 directly by the thermally responsive element. As a result, the retainer 10 can be prevented from deformation or extension due to the repeated strike.

Figure 4:
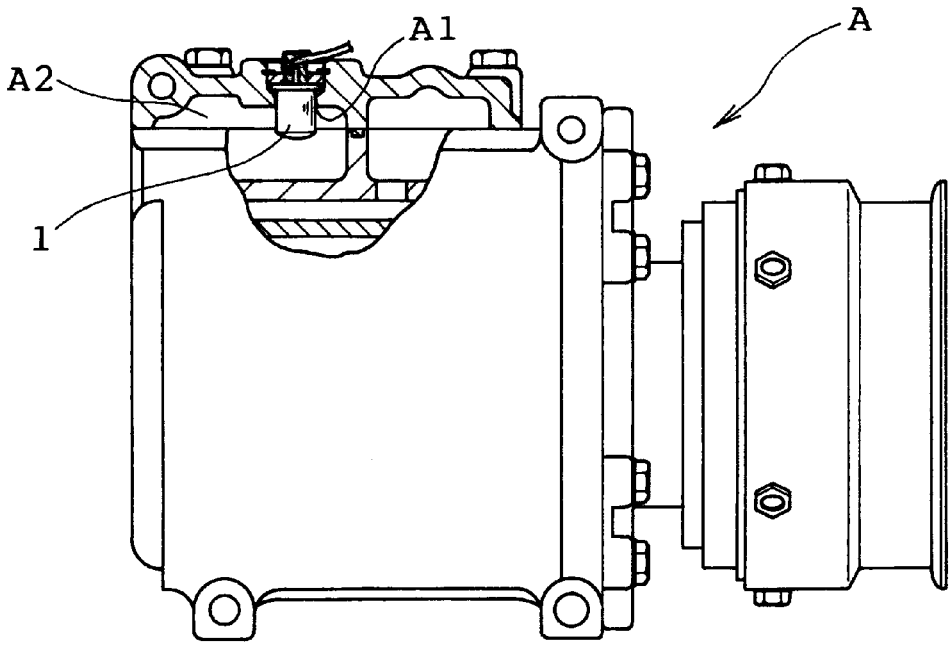
FIG. 4 is a partially sectional side view of a car air conditioner compressor on which the thermal switch of the embodiment is mounted.
Figure 5:
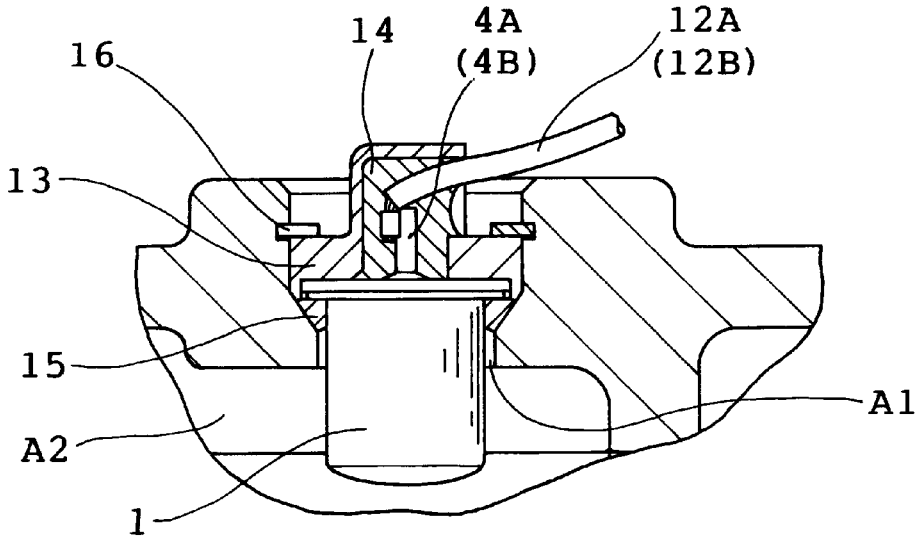
FIG. 5 is a partially enlarged view of the thermal switch in FIG. 4.
Figure 6:
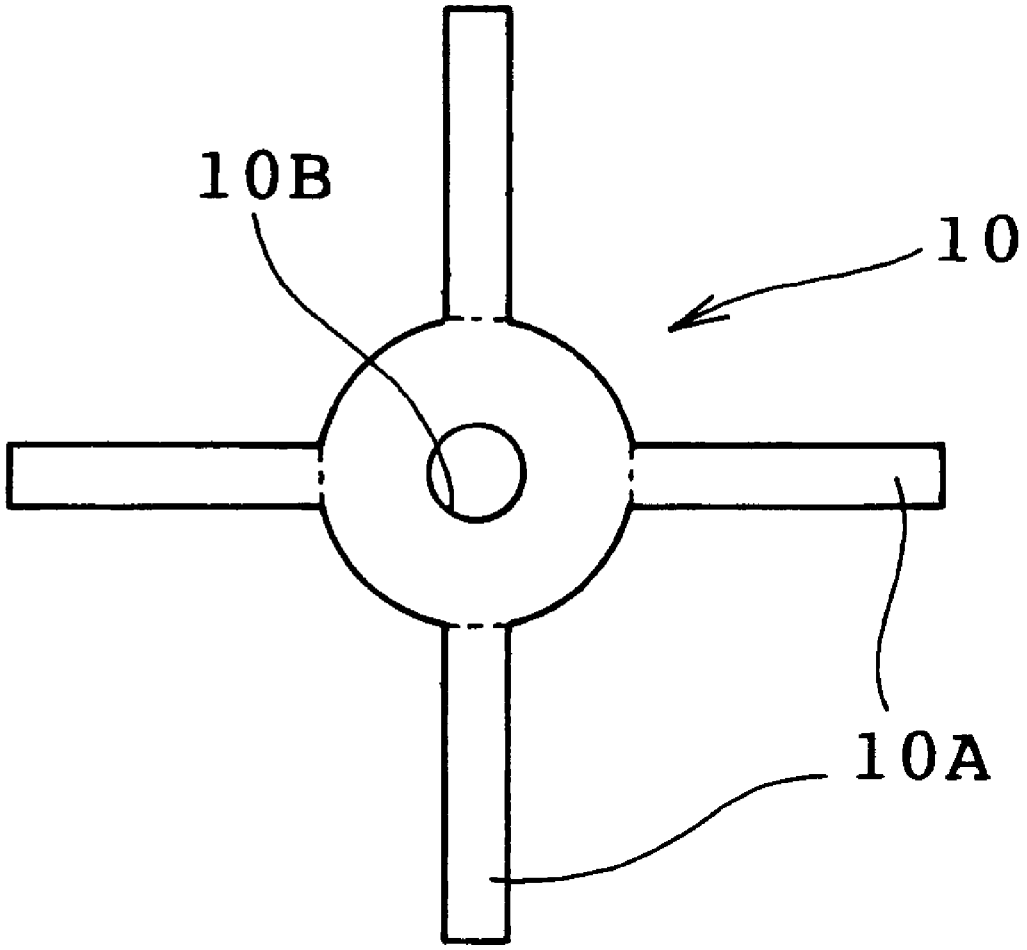
FIG. 6 is a plan view of a retainer used in the thermal switch.

The mounting of the thermal switch 1 on a compressor for a car air conditioner will now be described with reference to FIGS. 4 and 5. The car air conditioner includes a casing A which is the same as that of the car air conditioner in the description of the prior art and has a previously provided mounting section A1 for the thermal switch. The mounting section A1 is a through hole open to a discharged refrigerant passage A2 in the casing A. The mounting section A1 is located so that the thermal switch 1 mounted in it is exposed directly to the discharged refrigerant as a detected object so as to quickly detect a change in the temperature of the refrigerant.

The lead wires 12A and 12B are welded to the terminal pins 4A and 4B of the thermal switch 1 respectively. A protective cap 13 is put onto the thermal switch 1 in order that water etc. may be prevented from penetrating connections between the terminal pins are the lead wires during its service and the thermal switch may be protected against an external force or vibration applied thereto during the mounting. For these purposes, too, the mounting section A1 is filled with an insulating filler 14.

The thermal switch 1 is inserted into the mounting section A1 together with an O-ring 15, serving as a sealing member, made of silicon rubber or the like from outside the compressor. The O-ring 15 is caused to closely adhere to an inner wall of the mounting section A1, are outer wall of the metal housing 3 of the thermal switch and the flange of the header plate 2, so that the mounting section A1 is airtightly closed. Further, a known arcuate elastic member 16 such as a snap ring is attached to an upper peripheral end of the protective cap 13 to hold and fix the latter so that the thermal switch is prevented from falling off from the mounting section A1. Accordingly, since the thermal switch 1 is positioned outward relative to an inner surface of the outer wall of the compressor casing A, airtightness of the mounting section A1 and reliable fixation of the thermal switch can be achieved only by the O-ring 15 and the elastic member 16. In order that heat may be restrained from escape, the outer wall of the housing of the thermal switch 1 is adapted not to come into direct contact with the inner surface of the mounting section A1, namely, the outer wall of the compressor casing A. For this purpose, too, a metal portion including the header plate 2 is adapted not to come into direct contact with the compressor casing A. The housing of the thermal switch 1 is longer than that of the conventional thermal switch and accordingly, a lower half of the housing is exposed to the discharged refrigerant in the flow passage. Consequently, the thermal switch 1 can efficiently be subjected to heat from the refrigerant.

The transfer of heat from the housing bottom is restrained by increasing the length L of the cylindrical portion 3C of the housing 3 of the thermal switch 1. In order that the heat transferring speed may be further restrained, the length L of the cylindrical portion 3C needs to be further increased or the thickness t thereof needs to be reduced. However, when the length L of the cylindrical portion 3C is excessively increased, the thermal switch requires a larger mounting space, resulting in an increase in the size of a casing of the equipment to be protected by the thermal switch, for example, the casing of the compressor. Further if the thickness t of the housing is only reduced according to the requirement of increase in the operating speed of the thermal switch, the withstand pressure of the housing is reduced.

In view of the above-described problems, when the metal housing is made of a metal having a heat conductivity equal to one half or more preferably, one third of a heat conductivity of iron or below, the heat transferring speed can be restrained while the length and the thickness of the housing remain unchanged. Further, in a case where the length and the thickness of the cylindrical portion of the housing are set so as to be correlated with each other, the heat conducting speed of the housing can be restrained even when the housing is made of a metal having a heat conductivity higher than one half of that of iron, for example. This effect can further be increased when the housing is made of a metal having a heat conductivity sufficiently lower than iron, whereupon the response speed of the thermal switch can be increased. For example, the housing 3 is made of an iron alloy or a nickel alloy. In the embodiment, the housing 3 is made by pressing a stainless steel plate (SUS304) into the bottomed cylindrical shape by drawing. The housing 3 has a heat conductivity equal to one fifth of that of iron at the room temperature and approximately equal to one fourth of that of a cold-rolled steel plate conventionally used as the material for the housing.

When the housing is made of the material having a large electric resistance value, for example, stainless steel, the difference between the electric resistance values of the header plate and the housing becomes large such that part of metal melted during the welding sometimes scatters as dust. Operations of components and insulating performance of the thermal switch are adversely affected when the dust enters the housing of the thermal switch. In view of this problem, the header plate 2 has a circumferential edge in the vicinity of which a stepped portion 2A is provided and the housing 3 includes, in the vicinity of the open end thereof, an inner circumferential face adjacent to an outer edge of the stepped portion 2A of the header plate 2. Consequently, even when the dust results from the welding of the header plate 2 and the housing 3, the stepped portion 2A can prevent the dust from entering the housing. Further, the header plate 2 and the housing 3 can easily be positioned relative to each other in the assembly.

In the thermal switch 1 of the embodiment, the housing 3 is made of the metal having the heat conductivity equal to one half of that of iron or below, for example, the stainless steel, which heat conductivity is lower than that of the cold-rolled steel conventionally used as the material for the housing. Consequently, the thermal response speed of the thermal switch can be increased as compared with the conventional thermal switch. When the conventional thermal switch using a housing having a relatively good heat conductivity is mounted on the casing of the compressor, the heat of the housing bottom 3B is transferred through the housing to the thermally responsive element and simultaneously through the cylindrical portion of the housing to the header plate and the compressor casing both of which have lower temperatures respectively. Accordingly, the temperature increasing speed of the thermally responsive element is substantially restrained in the conventional thermal switch.

In the prior art, too, metal portions such as the header plate are adapted not to come into direct contact with the metal casing of the compressor when the thermal switch is mounted on the compressor. However, heat is transferred to resin closely adhering to the thermal switch consequently, a sufficient effect cannot be achieved in a case where a quick response speed is required, for example, when the temperature of a refrigerant is rapidly increased. Further, since the metal header plate constituting the hermetic housing has a larger thickness than the metal housing, the header plate has a relatively large heat capacity. Accordingly, heat transferred to the housing further transfers to the header plate. This is one of the causes for a delay in heating the thermally responsive element. Further, since the bottom of the housing is formed into the shallow dish shape so that the withstand pressure of the thermal switch is improved, the distance between the thermally responsive element and the bottom of the housing is slightly increased such that radiant heat from the housing bottom is difficult to reach the thermally responsive element. This is another cause for delay in heating the thermally responsive element.

When the hermetic housing is used as in the embodiment and the prior art, a ratio of helium contained in the filler gas filling the housing is increased so that the heat from the housing easily transfers to the thermally responsive element, whereupon the response time can be shortened. However, this is insufficient. Further, the header plate made of a resin having a lower heat conductivity than the metal is used instead of the metal one, or an opening is filled with a filler such as resin. However, this construction cannot substantially maintain airtightness and accordingly, the composition of the filler gas cannot be kept stable for a long period. As a result, an improvement in the heat conductivity cannot be expected.

In view of the foregoing, the inventors paid attention to the heat transfer from the housing bottom and made experiments. As a result, the inventors found that the operating time of the thermal switch was determined by a proper relation between the diameter D and the thickness t of the housing. More specifically, an area of the thermally responsive element changes in proportion to a square of the diameter of the cylindrical portion of the housing in which the thermally responsive element is accommodated. Accordingly, in a case where the thickness of the cylindrical portion 3C of the housing is fixed, a sectional area of an outer wall of the cylindrical portion iv increased relative to a unit area of the thermally responsive element when the diameter D of the cylindrical portion is reduced. As a result, heat apparently tends to escape through the cylindrical portion. Conversely, the heat becomes difficult to escape when the diameter D is increased. However, when the thickness t is excessively small relative to the diameter, the withstand pressure is reduced.

The inventors made experiments in view of the aforesaid points and reached a conclusion that the thickness t of the cylindrical portion should have been set to a range of 1/60 to 1/20 of the diameter D of the cylindrical portion. For example, when the thickness of the cylindrical portion is set to be equal to or above 1/20 of the diameter thereof, this setting increases an amount of heat transferred to the distal end of the housing and absorbed through the cylindrical portion into the header plate and the casing of the equipment to be protected by the thermal switch, whereupon the response time of the thermal switch is increased and accordingly, its responsiveness becomes insufficient. Further, the withstand pressure is reduced when the thickness t is equal to or below 1/60 of the diameter D. Accordingly, the pressure of the refrigerant may deform the housing 3 when the thermal switch is mounted on the compressor so as to be exposed to the refrigerant. On the other hand, when the thickness t is in the range of 1/60 to 1/20 of the diameter D, both the responsiveness of the thermal switch and the withstand pressure can be set to respective desired values.

Further, the operating time of the thermal switch can be determined from the heat conductivity of the housing, the length and the thickness of the cylindrical portion of the housing when the diameter of the housing is fixed. More specifically, the heat of the housing bottom is difficult to transfer externally when the heat conductivity of the housing is low. As the thickness of the cylindrical portion becomes small, the sectional area of the outer wall of the cylindrical portion is rendered smaller. Accordingly, the heat of the housing bottom is also difficult to transfer externally. Further, as the cylindrical portion becomes long, the heat of the housing bottom is more difficult to transfer externally. Consequently, the heat conductivity and the shape of the housing and the operating time of the thermal switch can be correlated by the following operating time index T:

$$T = A \cdot \lambda\left(\frac{t}{L}\right) + \frac{B \cdot t}{\sqrt{\lambda}} \tag{1}$$

where λ is a specific heat conductivity, t is a thickness of the cylindrical portion of the housing, L is a length of the cylindrical portion and A and B are constants.

The operating tine index T is approximately equal to the operating time of the thermal switch in the above-described experiments within a range of predetermined condition. Accordingly, when the operation time index T is compared with the one of the conventional thermal switch, the operating time can easily be estimated from the heat conductivity and the shape of the housing. For example, the following estimated operating time can be obtained in the relation of the thermal switches of the embodiment and the aforesaid conventional one:

$$T1 = 32000\lambda\left(\frac{t}{L}\right) + \frac{2.2t}{\sqrt{\lambda}} \tag{2}$$

where $0.1 \leqq t \leqq 0.6$ (m), $4 \leqq L \leqq 20$ (mm), and $0.005 \leqq \lambda \leqq 0.1$ [W/(mm•K)].

An alternative characteristic experiment to obtain the aforesaid operating time T1 will be described. The thermal switch used in the experiment had a diameter D of 12.8 mm. The thermally responsive element to be accommodated in the housing had a diameter of 12.0 nm. The header plate had a diameter of 17 mm and a thickness of 1.6 mm. The header plate was made of a cold-rolled steel plate (SPCE) and the terminal pins were secured to the header plate in the above-described manner. The filler gas filling the housing consisted of 75%-nitrogen and 25%-helium and the filler gas pressure was 130 kPa. The protective cap 13 and the lead wires as shown in FIG. 4 were attached to the thermal switch in the experiment. The housing of the thermal switch which was set to operate at 155° C. was immersed in a silicon oil the temperature of which was at 180° C. without the other portions of the housing such as the header plate coming into contact with the silicon oil. A tine elapsing until the operation of the thermal switch was measured.

The estimated operating time index T1 agrees, to a large degree, with operating times obtained in the experiment when the housing thickness t is ranged between 0.1 and 0.6 mm, the length L of the cylindrical portion is ranged between 4 and 20 mm, and the heat conductivity of the housing is ranged between that of iron and that of stainless steel. For example, the estimated operating time index T1 is 14.99 sec. when the thermal switch of the embodiment includes the housing made of the stainless steel plate (SUS304) and having the heat conductivity of 0. 015 W/(mm•K) and the thickness t of 0.3 mm, and the cylindrical portion having the length L of 12.1 mm. This estimated operating time T1 agrees approximately with an average measured value of 15.2 sec. FIG. 7 shows the relationship between the estimated operating times and the results of experiment of various examples. The cylindrical portion of the housing of each thermal switch has the diameter of 12.8 mm.

Figure 8:
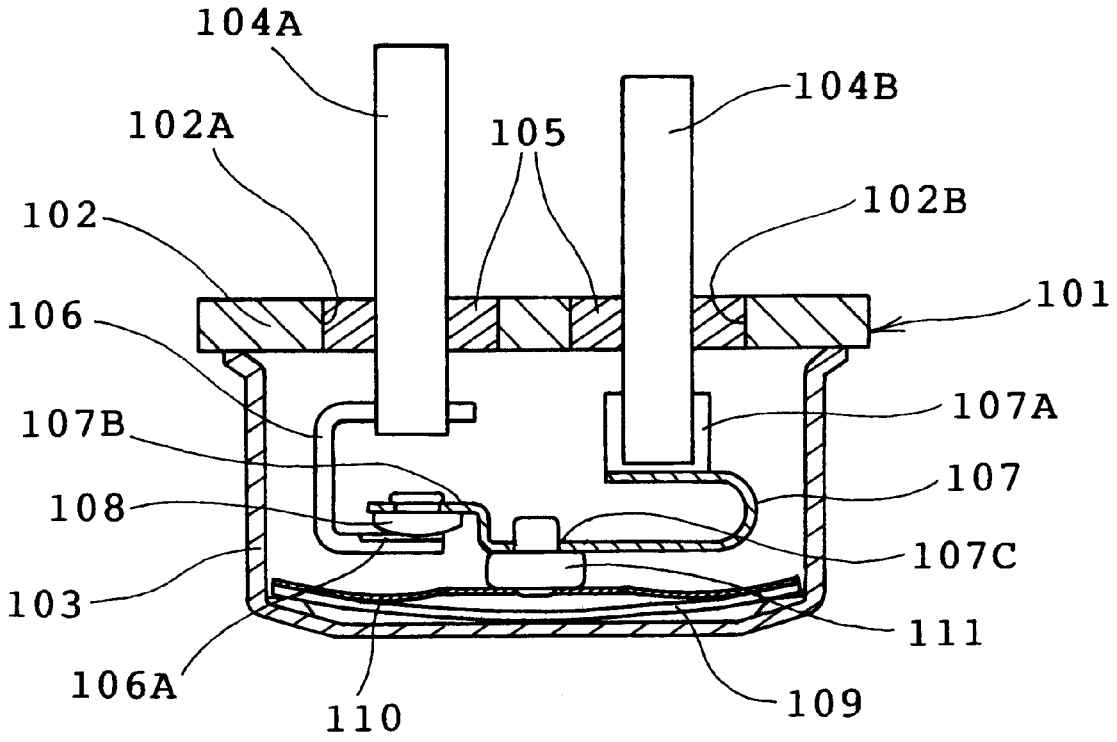
FIG.8 PRIOR ART
FIG. 8 is a longitudinal section of a conventional thermal switch.
Figure 9:
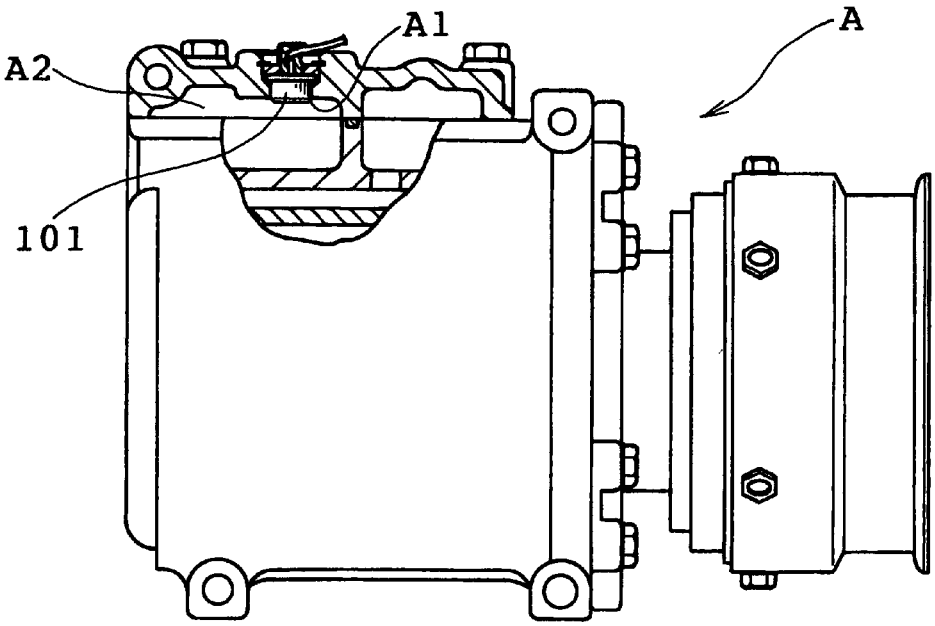
FIG.9 PRIOR ART
FIG. 9 is a partially sectional side view of a car air conditioner compressor on which the conventional thermal switch shown in FIG. 8 is mounted.
Figure 10:
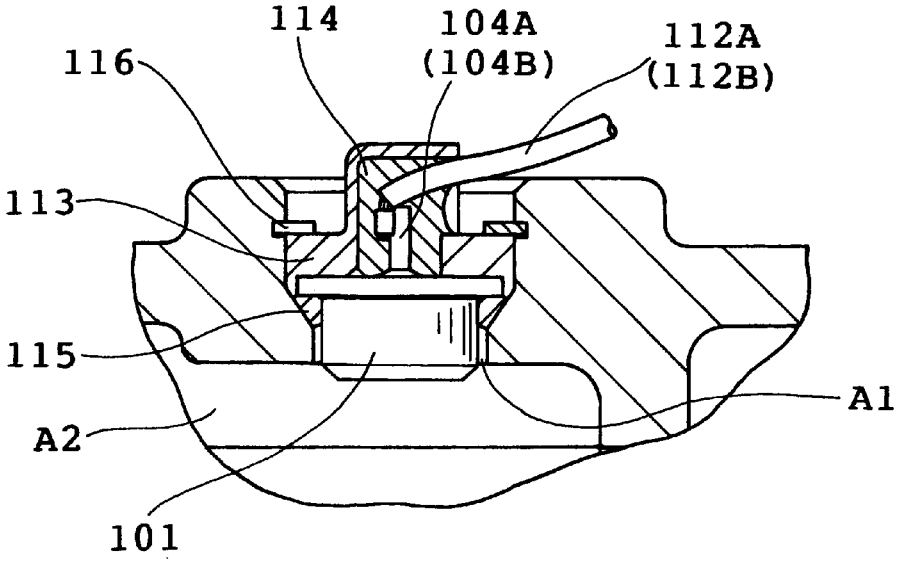
FIG.10 PRIOR ART
FIG. 10 is a partially enlarged view of the conventional thermal switch in FIG. 9.
Figure 11:
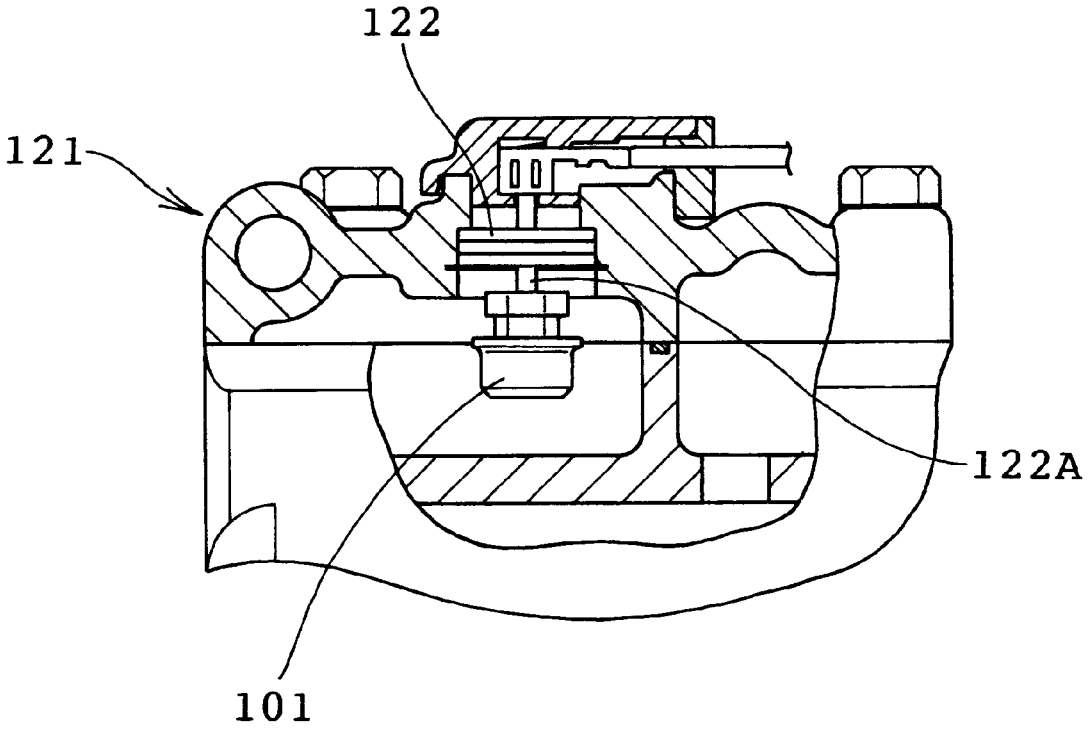
FIG. 11 PRIOR ART
FIG. 11 is a view similar to FIG. 10, showing another mounting manner.

As obvious from FIG. 7, the estimated operating times agree approximately with the operating times of the respective samples in the experiment. From the estimated operating times and the measured values, the operating time is improved 20% relative to the prior art when the length L of the cylindrical portion is set to be equal to or above one half of its diameter D. More specifically, when the length L is 6.8 mm and the diameter D is 12.8 mm, an average measured value of the operating times is less than 90 sec. on the other hand, the operating time is about 115 see. in the prior art thermal switch shown in FIG. 8, in which the length L is 5.5 mm.

The thermal switch necessitates the responsiveness of 90 sec. or less and preferably 60 sec. or less in the experiment. More specifically, each of the thermal switches of examples 1, 2 and 3 in FIG. 7 achieves a thermal responsiveness further higher than or superior to that of each aforesaid thermal switch. An estimated operating time index T1 of each of the thermal switches of examples 1, 2 and 3 corresponds to a performance which is equal to or higher than the performance of the conventional thermal switch shown in FIG. 8 in a case where the overall housing thereof is exposed to the refrigerant in use of the thermal switch. This conventional switch comprises the housing made of a cold-rolled steel plate with a heat conductivity of 0.062 W/(mm•K) and having a thickness t of 0.3 mm, the housing including a cylindrical portion with the length L of 5.5 mm. Examples 1 to 3 in each of which the thermal switch includes a stainless housing meet this requirement as shown in FIG. 7. This result was confirmed in another experiment in which the thermal switch of each example was actually mounted on equipment to be protected by the thermal switch. Concerning examples 4 and 5 in each of which the housing was made of a cold-rolled steel plate, the responsiveness as achieved by each of examples 1 to 3 cannot be obtained. However, these examples show that the operating time can be shortened to a large degree as compared with that of the prior art by selecting the housing thickness t, the diameter D and the length L of the cylindrical portion.

From the values obtained from the aforesaid equations and the experimental results, a sufficient operating speed can be obtained in a case where the heat conductivity of the housing is set to be equal to or small than one half of that of iron ($\lambda$=0.075 W/(mm•K)) and equal to or smaller than about two thirds of that of the conventionally used steel when the housing is formed into the same shape as that of the conventional thermal switch. Further, when the length L of the cylindrical portion is rendered larger than that in the conventional thermal switch, the transfer of heat to the header plate is delayed such that the response time of the thermal switch can be shortened. From the aforesaid equation, the length of the cylindrical portion needs to be rendered twice as long as that of the prior art or above in order that the same operating performance as obtained in a case where the overall switch is exposed to the refrigerant or higher performance may be achieved when the thickness and heat conductivity of the housing are the sarie as those in the prior art.

The correlation obtained from the aforesaid equation is particularly suitable with high accuracy for a case where the diameter of the cylindrical portion of the housing is ranged between 8 and 15 mm. In equation (2), the constants A and B in equation (1) have been determined according to the experimental results of the thermal switch of the embodiment having a specific shape. For example, when the diameter of the housing or the like is changed, these constants A and B are set according to a new condition so that the operating time approximate to an actual value can be obtained.

On the other hand, the thermal responsiveness of the thermal switch can be improved by increasing the heat conductivity of a filler gas filling the housing thereof. The filler gas serves to transfer heat of the switch housing to the thermally responsive element and simultaneously to cause the heat to escape to the header plate due to its convection in the housing. However, since the thermally responsive element is adjacent to the bottom of the housing in the structure of the thermal switch of the embodiment, it is confirmed that the heat transferred through the filler gas to the thermally responsive element acts more effectively than the heat transferred to the header plate by convection. Particularly when a rapid temperature increase is detected, it is effective to adjust the heat conductivity of the filler gas, or more specifically, to increase a ratio of helium contained in the filler gas or to increase a filler gas pressure.

In other words, the hermetic housing of the thermal switch is filled with a predetermined gas so that a predetermined operating performance is maintained for a long period. The housing is filled with a helium gas for inspection of airtightness together with dry air and nitrogen. Since helium has a higher heat conductivity than dry air and nitrogen, the ratio of helium in the filler gas is increased so that the heat conductivity of the filler gas is increased, whereupon beat can be transferred from the housing to the thermally responsive element more quickly.

Helium has a heat conductivity about six times as high as nitrogen and air. Accordingly, heat of the housing can be transferred to the thermally responsive element more quickly particularly in the case of a rapid temperature increase. For example, in three thermal switches including respective housings made of a steel and operating at 155° C., the filler gas contains 25%-helium in one switch, 50%-helium in another and 75%-helium in the other. When only the housing of each thermal switch is immersed in a silicon oil the temperature of which is at 180° C., the response time can be improved about 5% in the thermal switch using 50%-helium relative to that in the thermal switch using 25%-helium. Further, the response time can be improved about 10 to 15% in the thermal switch using 75%-helium relative to that in the thermal switch using 25%-helium.

Thus, by setting the content ratio of helium in the filler gas to 50% or above, the speed at which the temperature of the thermally responsive element rises can be increased quickly relative to a temperature rise of the refrigerant gas serving as a heat carrier within a short period of time. The content ratio of helium is more preferably set to 75% or above. When the content ratio of helium approximates to 100%, the withstand voltage between the movable and fixed contacts drops when the movable contact is disengaged from the fixed contact. There is no substantial problem when an automobile battery serves as a power source for the thermal switch. However, when the withstand voltage between the contacts is measured for inspection of a distance between the contacts in an inspection step of the manufacture, a voltage range is rendered narrower and accordingly, it is difficult to determine the distance between the contacts. In view of this problem, an upper limit of the content ratio of helium is preferably set to 95%. Two thermal switches each having the construction shown in FIG. 1 are compared. The switch housing is made of stainless steel in each thermal switch. In one thermal switch, the filler gas contains 25%-helium and 75%-nitrogen. The filler gas contains 75%-helium and 25%-nitrogen in the other. When these thermal switches are compared, the operating time in the former switch is shortened 20% or more relative to that of the latter in an alternative characteristic experiment using silicon oil. A change rate is larger in the case where the housing is made of stainless steel than the above-described case where the housing is made of steel. Since the stainless steel has a lower heat conductivity as described above, the temperature of the housing bottom is rapidly increased. The change in the filler gas content is effective in order that the heat of the housing bottom% may be efficiently transferred to the thermally responsive element.

In the foregoing embodiment, the housing of the thermal switch is made of stainless steel. However, an iron-nickel alloy, an iron-chrome alloy, a nickel-chrome alloy or a nickel-copper alloy may be selected as the metal having the heat conductivity equal to one half or more preferably, at least one third, of a heat conductivity of iron or below, instead.

The lead wires are soldered to the thermal switch in the prior art. However, solder has a relatively low melting temperature. For example, accordingly, there is a possibility of disconnection of the lead wires under the condition where the thermal switch is temporarily exposed to the temperature at or above 200° C. As a result, the conventional thermal switch could not be used under such a condition. In view of this problem, the lead wires 12A and 12B are welded directly to the respective terminal pins 4A and 4B using a resistance welder etc. in the thermal switch of the embodiment as shown in FIG. 5. Consequently, the electrical connection between the lead wires and the thermal switch is reliably maintained even in a high temperature environment as compared with the conventional thermal switch and accordingly, the thermal switch of the embodiment can serves as the one operating at higher temperatures than the conventional thermal switch.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

We claim:

1. A thermal switch comprising:

a generally circular metal header plate having two through holes;

first and second terminals inserted through and airtightly fixed in the through holes of the header plate by an electrically insulating filler respectively;

a metal housing including a cylindrical portion having an open end and a generally shallow dish-shaped bottom, the open end being welded to the header plate so that the metal housing and the header plate constitute a hermetic housing;

a generally circular thermally responsive element formed into the shape of a shallow dish and disposed on the bottom of the metal housing, the thermally responsive element reversing a curvature thereof at a predetermined first temperature with snap action and re-reversing the curvature thereof at a predetermined second temperature with snap action to return to a former state thereof;

a retainer having elasticity and disposed opposite the thermally responsive element;

a fixed contact member welded to the first terminal;

a movable contact member welded to the second terminal; and a pressure piece provided on the movable contact member so as to confront the thermally responsive element;

wherein the fixed and movable contact members have weld portions welded to the first and second terminals respectively in such a manner that when a welding jig is disposed on each of imaginary lines extending in one and the same direction and passing through centers of the terminals and weld points respectively, disposition of the welding jig for either one terminal is allowed by the other terminal;

wherein the metal housing has a thickness set to a range of 1/60 to 1/20 of a diameter of the cylindrical portion thereof and a length of the cylindrical portion is set to a value equal to one half as large as the diameter thereof or above, so that heat conduction through the bottom of the metal housing to the thermally responsive element and heat conduction from the housing bottom side through the cylindrical portion of the housing toward the header plate are regulated so that a temperature rise rate of the thermally responsive element is adjusted; and wherein the hermetic housing is disposed on a casing of a compressor to be protected by the thermal switch so that the cylindrical portion of the metal housing airtightly extends through a mounting through hole formed in the casing with a sealing member being interposed therebetween, wherein only a lower portion of the hermetic housing is exposed to a discharged refrigerant flow passage in the casing.

2. A thermal switch according to claim 1, wherein the hermetic housing is filled with a filler gas containing 50 to 90%-helium with a charge pressure equal to or above an atmospheric pressure.

3. A thermal switch according to claim 1, wherein lead wires are welded to the first and second terminals respectively.

4. A thermal switch according to claim 1, wherein the header plate has a circumferential edge in the vicinity of which a stepped portion is provided and the housing include, in the vicinity of the open end thereof, an inner circumferential face adjacent to an outer edge of the stepped portion of the header plate.

5. A thermal switch according to claim 4, wherein lead wires are welded to the first and second terminals respectively.

6. A thermal switch comprising:

a generally circular metal header plate having two through holes;

first and second terminals inserted through and airtightly fixed in the through holes of the header plate by an electrically insulating filler respectively;

a metal housing including a cylindrical portion having an open end and a generally shallow dish-shaped bottom, the open end being welded to the header plate so that the metal housing and the header plate constitute a hermetic housing;

a generally circular thermally responsive element formed into the shape of a shallow dish and disposed on the bottom of the metal housing, the thermally responsive element reversing a curvature thereof at a predetermined first temperature with snap action and re-reversing the curvature thereof at a predetermined second temperature with snap action to return to a former state thereof;

a retainer having elasticity and disposed opposite the thermally responsive element;

a fixed contact member welded to the first terminal;

a movable contact member welded to the second terminal; and a pressure piece provided on the movable contact member so as to confront the thermally responsive element;

wherein the fixed and movable contact members have weld portions welded to the first and second terminals respectively in such a manner that when a welding jig is disposed on each of imaginary lines extending in one and the same direction and passing through centers of the terminals and weld points respectively, disposition of the welding jig for either one terminal is allowed by the other terminal;

wherein the metal housing is made of a metal having a heat conductivity equal to one half of a heat conductivity of iron or below so that when the metal housing portion is subjected to heat, a conductivity of the heat transferred to the header plate side is restrained and a temperature rise rate of the housing bottom is increased; and wherein the hermetic housing is disposed on a casing of a compressor to be protected by the thermal switch so that the cylindrical portion of the metal housing airtightly extends through a mounting through hole formed in the casing with a sealing member being interposed therebetween, wherein only a lower portion of the hermetic housing is exposed to a discharged refrigerant flow passage in the casing.

7. A thermal switch according to claim 6, wherein lead wires are welded to the first and second terminals respectively.

8. A thermal switch according to claim 6, wherein the header plate has a circumferential edge in the vicinity of which a stepped portion is provided and the housing includes, in the vicinity of the open end thereof, an inner circumferential face adjacent to an outer edge of the stepped portion of the header plate.

9. A thermal switch according to claim 8, wherein lead wires are welded to the first and second terminals respectively.

10. A thermal switch according to claim 6, wherein the hermetic housing is filled with a filler gas containing 50 to 90%-helium with a charge pressure equal to or above an atmospheric pressure.

11. A thermal switch according to claim 6, wherein the metal housing is made of an alloy of iron and chrome, an alloy of iron and nickel, an alloy of iron, nickel and chrome or an alloy of nickel and chrome.

12. A thermal switch according to claim 11, wherein the hermetic housing is filled with a filler gas containing 50 to 90%-helium with a charge pressure equal to or above an atmospheric pressure.

13. A thermal switch according to claim 11, wherein lead wires are welded to the first and second terminals respectively.

14. A thermal switch according to claim 6, wherein the metal housing has a thickness set to a range of 1/60 to 1/20 of a diameter of the cylindrical portion thereof and a length of the cylindrical portion is set to a value equal to one half as large are the diameter thereof or above, so that heat conduction through the bottom of the metal housing to the thermally responsive element and heat conduction from the housing bottom side through the cylindrical portion of the housing toward the header plate are regulated so that a temperature rise rate of the thermally responsive element is adjusted.

15. A thermal switch according to claim 14, wherein lead wires are welded to the first and second terminals respectively.

16. A thermal switch according to claim 14, wherein the hermetic housing is filled with a filler gas containing 50 to 90%-helium with a charge pressure equal to or above an atmospheric pressure.

17. A thermal switch according to claim 14, wherein the metal housing is made of an alloy of iron and chrome, an alloy of iron and nickel, an alloy of iron, nickel and chrome or an alloy of nickel and chrome.

18. A thermal switch according to claim 17, wherein the hermetic housing is filled with a filler gas containing 50 to 90%-helium with a charge pressure equal to or above an atmospheric pressure.

19. A thermal switch according to claim 17, wherein lead wires are welded to the first and second terminals respectively.

* * * * *